United States Patent [19]

Haskins

[11] 4,203,368

[45] May 20, 1980

[54] LOAD HANDLING SYSTEM

[76] Inventor: Albert R. Haskins, 1621 Walnut St., Park Ridge, Ill. 60008

[21] Appl. No.: 761,148

[22] Filed: Jan. 21, 1977

[51] Int. Cl.[2] ..... B61B 3/00

[52] U.S. Cl. ..... 104/92; 52/39

[58] Field of Search ..... 104/92, 95, 96, 102, 104/103; 49/125, 127; 52/39, 64; 176/30, 87

[56] References Cited

U.S. PATENT DOCUMENTS

| | | | |
|---|---|---|---|
| 989,899 | 4/1911 | Ferris | 104/103 |
| 1,389,668 | 9/1921 | Krump | 104/103 |
| 1,602,379 | 10/1926 | Lawrence | 104/103 |
| 1,640,344 | 8/1927 | Bennington | 104/92 |
| 2,410,934 | 11/1946 | French | 104/103 |
| 3,142,096 | 7/1964 | Munchhausen | 49/127 |
| 3,445,012 | 5/1969 | Freeborg | 214/18 N |

FOREIGN PATENT DOCUMENTS

| | | | |
|---|---|---|---|
| 1070103 | 11/1959 | Fed. Rep. of Germany | 104/96 |
| 609510 | 10/1948 | United Kingdom | 104/103 |

*Primary Examiner*—Francis S. Husar
*Assistant Examiner*—Ross Weaver
*Attorney, Agent, or Firm*—Ladas & Parry

[57] ABSTRACT

An apparatus for moving loads from one position to another, employing an arrangement of a plurality of loop and/or spur tracks supported from above and having terminals converging in a direction of a pivot point having secured thereat a radial transfer track having a free swinging end adapted to couple with any of the loop and/or spur tracks to effect transfer of a hoisted load supported on one of the tracks, to another track via the radial transfer track. The radial transfer track is supported, adjacent its swinging end, on an arcuate support track which is concentric to an arcuate line passing through all of the converging terminals of the loop and/or spur tracks.

7 Claims, 3 Drawing Figures

LOAD HANDLING SYSTEM

BACKGROUND OF THE INVENTION

This invention is generally concerned with an apparatus for transporting loads in a closed installation from one position to another, and more particularly concerned with transportation of loads in a congested area filled with structural members and operating devices having very limited spatial clearances therebetween.

Arrangements for transporting loads or equipment from one position to another, during manufacturing processes, are generally known. For example, a common arrangement comprises the use of a monorail track suspended from a ceiling and supporting thereon a hoist trolley having secured thereto a suspended member such as a chain and hook adapted to be attached to a load to be moved. The hoist trolley can be moved manually or can be motorized for moving heavy objects to a desired place. Occasionally, it is desired to move the load from one track to another track which is either located parallel or at an angle to the first track. In this situation, it is necessary to have a movable portion of a track which is capable of coupling between the various tracks used in a particular system. This movable portion of the track which can be called a transfer section is generally supported on a crane which moves or rolls along one or more girders which provide a connecting access between the transfer section and the other tracks. To obtain transfer of a load from one track to another the load is moved by means of a hoist trolley from one track to the transfer section supported by the crane. Thereafter, the transfer section together with the hoist trolley and the supported load are moved by the crane to a position adjoining the other track. The other track is then coupled with the transfer section and the hoist trolley together with the load is transferred to the other track.

Another conventional form of a transfer section, commonly called a glide switch, comprises a rectangular box structure having a stationary fram supporting a sliding steel plate having secured thereto sections of straight and curved tracks. The glide switch is generally positioned in an intermediate position of a straight track adjoining the end of a second track terminating perpendicularly to the first track. If a load is to be transferred from the first to the second track, the load is moved from the first track to the switch, onto the curved track section and then moved onto the second track. As is apparent, if additional perpendicular tracks are used, each interchange between tracks requires the use of a glide switch. In view of the box structure shape of the glide switch, a substantial area is required for accommodating such a glide switch. For example, a conventional glide switch capable of supporting a heavy load will have dimensions of about 3×6 feet (18 sq. ft.).

Although the use of the transfer section supported by the crane or the use of a glide switch for moving loads is satisfactory in most applications, they cannot be used in areas which are congested with structural members affording very little space clearance, for example as present inside a nuclear power plant. In view of the severe spatial overhead limitations existing in the nuclear power plant, the conventional transfer section on a crane or a glide switch cannot be used.

The invention described herein uses a radial or a transfer track pivotally anchored at one end with the free end movably supported on an arcuate or support track and adapted to intercouple with free ends of a plurality of loop and/or spur tracks which extend over areas which are to be serviced by a hoist trolley. The use of an arcuate track is shown in U.S. Pat. No. 1,530,337 which describes a cupola charging machine that is supported on such arcuate track. Such known arcuate track, however, is not used in conjunction with a plurality of loop and/or spur tracks and a radial transfer track.

The load handling system, described herein, is particularly useful in transporting equipment from a point of installation to another point for inspection in an operational area which is filled with structural and operational members having limited space therebetween. The system has been designed for use in a nuclear power plant using the known Boiling Water Reactor BWR-6 and Mark III containment, such installation having a maze of pipes adjacent to a reactor core. The described load handling system permits various equipment, such as main steam isolation valves and safety relief valves, to be removed from their operative positions to an inspection area for servicing, calibration and/or replacement.

Such a nuclear power plant has a centrally located reactor core surrounded by shielding means and located in a drywell area encompassed by a drywell wall. The drywell wall is, in turn, encompassed by a containment wall. In the drywell area there is located a maze of pipes conducting water and steam and running in various horizontal and vertical directions. In addition, various equipment is located in the drywell area including a number of main steam isolation valves and safety relief valves. In view of the limited space existing between the pipes and the various equipment located in the drywell area, the presently known systems for removing the equipment from the drywell area possess certain disadvantages. For example, a load handling system using a crane requires the use of one or more girder beams for supporting the transfer section. The use of such girder beams requires sufficient space for installation. Since some of the tracks are angularly positioned with respect to the crane, the transfer section has to be provided with one or more arcuate sections of tracks so these may be aligned properly in order to effect transfer of equipment between thr transfer section and the tracks. On the other hand, a load handling system using a glide switch also requires sufficient space. Further, each track interchange requires a glide switch, additionally compounding the spatial problem. Furthermore, the load handling system has to be so constructed as to permit the various structural members of the power plant to move independently of each other in case of earth tremors. In other words, the load handling system has to be constructed so that it does not affect the seismic design of the shield wall surrounding the nuclear core.

SUMMARY OF THE INVENTION

It is therefore an object of this invention to provide a simplified apparatus for transporting loads from one position to another in a congested area.

Another object of this invention is to provide a load handling system capable of use in an area filled with structural members having very limited space therebetween.

Yet another object of this invention is to provide a load handling system using a minimum of support structure for transporting equipment from one position to another.

A still further object of the invention is to provide a load handling system using a plurality of extending tracks communicating with a common transfer track employing a pivotal radial section to effect transfer of loads between the various extending tracks.

Another object of the invention is to provide means for adjustably positioning a transfer track with respect to ends of a plurality of loop and/or spur tracks to obtain proper clearance therebetween.

A further object of the invention is to provide a load handling system using a plurality of tracks which are supported from a drywell ceiling, independent of any support from the shield wall.

The system described herein has been developed to facilitate the initial installation of structural components and equipment in the drywell area during erection of the nuclear power plant and provide ease of maintenance and inspection of the safety relief valves and the main steam isolation valves used in a nuclear power plant. The object is to remove the valves from the drywell area to a common removal area from which the valves can be transported through a hatch opening in the drywell wall to an inspection and repair area. It is essential that the maintenance personnel be required to remain only a limited time in the drywell area while removing the valves in view of the possible residual radiation existing in the area.

The load handling system uses a monorail track arrangement suspended from a drywell ceiling structure by any suitable means such as hangers. In view of the weight of the valves, it is essential that the monorail track possess sufficient structural integrity. For example, the safety relief valve weighs about 4,000 pounds, and the total weight of the main steam isolation valve is about 17,000 pounds. Of course, the main steam isolation valve is removed in sections; the upper section, identified as the upper assembly, weighs about 6,000 pounds. The upper assembly is quite massive, having overall dimensions of approximately 4 ft. by about 8 ft.

The load handling system comprises a track arrangement having a desired number of tracks, a transfer track, a hoist trolley supportable on the tracks, an interlock for maintaining the hoist trolley on the tracks, a hoist and a trolley motor, all supported from the ceiling above the drywell area. The system includes a loop track which almost completely encircles the reactor core and a number of spur tracks adjacent to the reactor core. The tracks are, of course, supported so they are essentially positioned over the individual areas occupied by the various valves. One or more hoists can be utilized at the same time on different tracks or on different portions of the tracks, thereby permitting more than one crew to work in the drywell area at the same time.

The hoist, interlock, the transfer track and the trolley can be either operated manually or by remote control, requiring only a minimum effort on the part of a crew to move the massive valves from the operational sites to the unloading zone.

The loop and the spur tracks interconnect with a radial transfer track having one end pivotally secured adjacent the drywell wall and having its other end movably suspended and supported by an arcuate support track. The radial track can be pivoted in any direction to line up with a particular loop or spur track to effect an interchange. For example, if a valve is hoisted on a spur track, it is brought over and transferred to the radial track which is then pivoted to effect an interchange with the loop track, so the equipment can then be moved along the loop track to the removal area for subsequent removal through the hatch opening in the drywell wall to the inspection zone.

The described load handling system enables the drywell area around the shield means to be completely serviced. In addition to use of the system for removing the various valves, it can also be employed to perform other maintenance functions in the drywell area.

DESCRIPTION OF THE DRAWINGS

The invention will now be described in reference to the accompanying drawings, wherein.

DESCRIPTION OF THE PREFERRED EMBODIMENT

Figure 1:
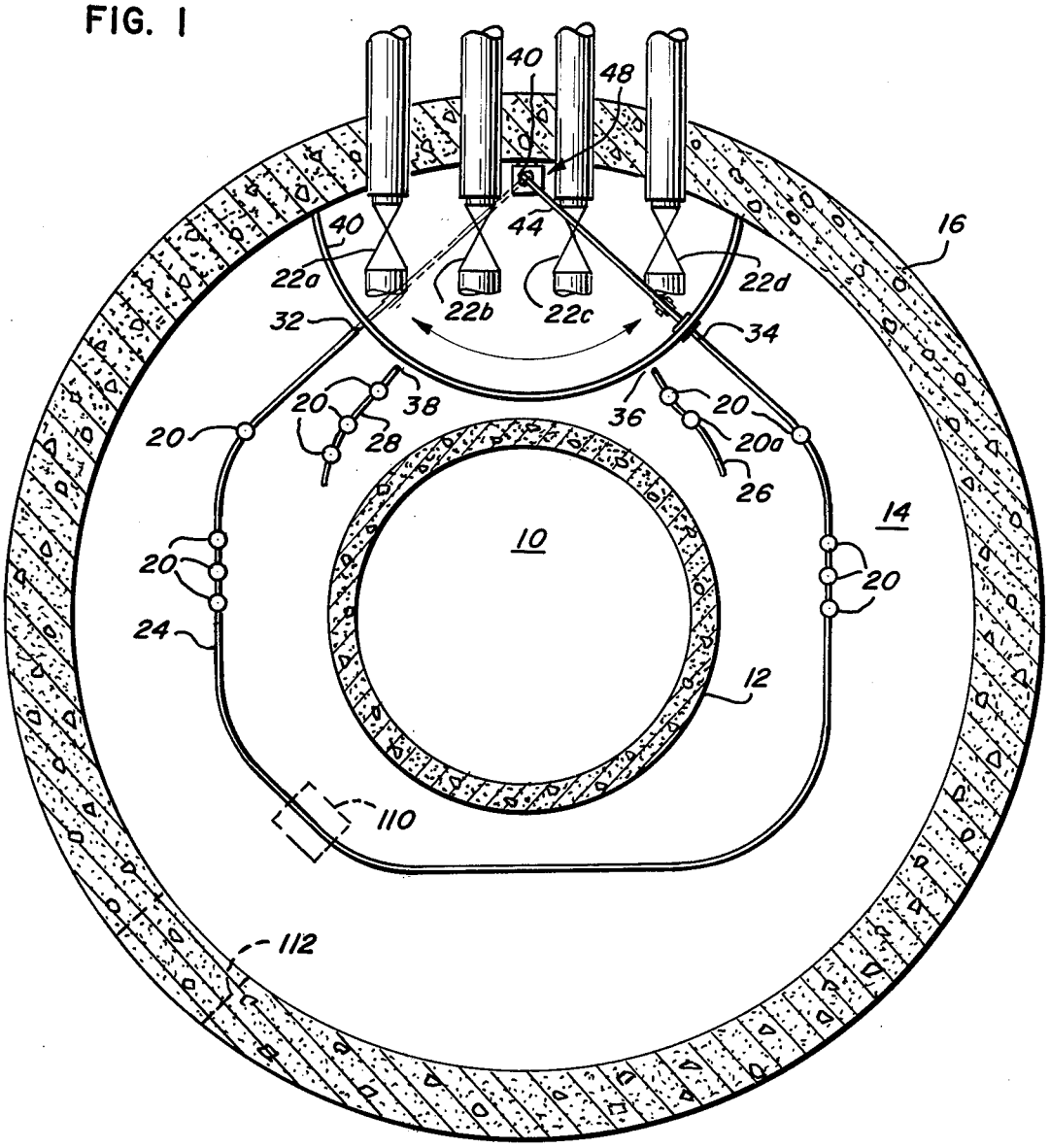
FIG. 1 is a plane view of a simplified cross section of a nuclear power plant installation provided with the load handling system.
Figure 1:
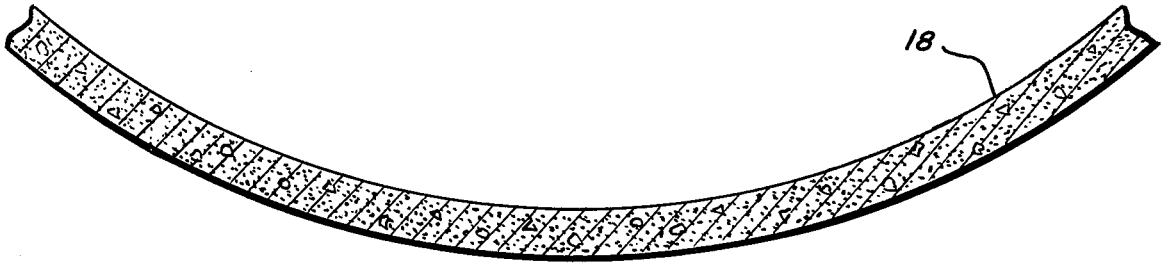

Referring to FIG. 1, there is disclosed a simplified layout of a nuclear power plant having a reactor core 10 surrounded by a shield wall 12 disposed in a drywell area 14 surrounded by a drywell wall 16 which, in turn, is surrounded by a containment wall 18.

The reactor core 10 is surrounded by a multitude of structural elements such as pipes, fittings, conduits, which extend upwardly and horizontally and which virtually fill the entire space in the drywell area 14 extending between the shield wall 12 and the drywell wall 16. For reasons of simplification, these structural elements are not shown except for a number of valves which form a part of the safety relief system and the main steam valves which interconnect the interior of the reactor core and the electrical generating equipment situated outside of the building housing the reactor core.

As shown in FIG. 1, a large number of relief safety valves 20 are disposed at predetermined locations adjacent to the reactor core 10. The steam output of the reactor core passes through a series of main steam isolation (MSI) valves 22*a*, 22*b*, 22*c* and 22*d*.

As was previously indicated, these MSI valves are bulky and heavy and require a properly designed load moving apparatus which is capable of removing and transporting the valves to a maintenance area for periodic inspections.

The present invention comprises a load handling system employing a loop monorail track 24 which generally encircles the reactor core 10, and a number of spur monorail tracks 26, 28 which extend for a short distance about the reactor core 10. The loop track 24 and the spur tracks 26, 28 are suspended by hangers 30 (FIG. 3) solely from a ceiling 31 supported by the drywell wall 16. This arrangement provides an important feature of the invention which is described hereinafter in detail.

The loop track 24 terminates in terminals or ends 32, 34 and the spur tracks 26, 28 terminate in terminals or ends 36, 38 respectively. These terminals are disposed along an arcuate path adjacent to a generally semi-circular support track 40 supported by a series of hangers 42 (FIG. 3) secured to the drywell area ceiling 31.

The arcuate support track 40 defines a path for movably supporting a radial transfer track 44 having one of its ends 46 pivotally secured at a point 48 attached to the drywell wall 16.

Figure 2:
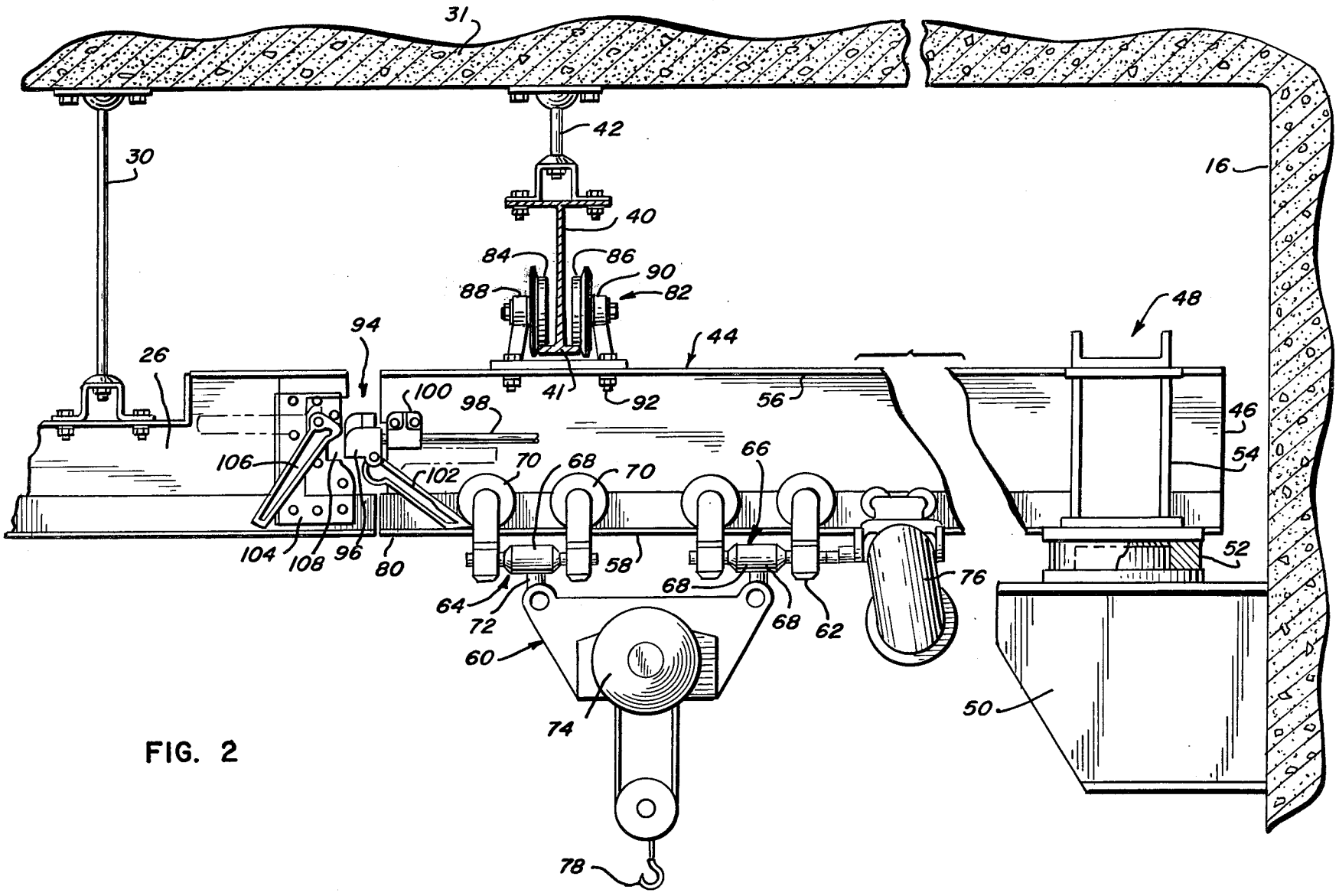
FIG. 2 is a side view of a radial beam intercoupling with a monorail track used in the load handling system.

The pivotal securement of the radial transfer track 44 is shown in detail in FIG. 2, wherein a beam support 50 is secured to the drywell wall 16 and supports a pivot bearing 52 having mounted thereon a beam bracket 54 which is adapted to adjustably secure one end of the radial transfer track 44.

The constructions of the loop track 24 and the spur tracks 26, 28 as well as the arcuate support track 40 can comprise any conventional flanged track. By way of example, a cross-sectional end view of the track 40 is observable in FIG. 2, wherein the track is supported by hangers 42. Other cross-sectional configurations of tracks may be utilized.

As shown in FIG. 2, the radial transfer track 44 has an upper flange 56 and a lower flange 58, the latter supporting a hoist arrangement 60 comprising a hoist trolley 62 movably supported on the lower flange 58, the hoist trolley 62 comprising a pair of carriers 64, 66. Each carrier, for example carrier 64, includes a horizontally disposed load bar 68 supported by two pairs of wheels 70, each pair of wheels straddling the lower flange 58 of the radial transfer track 44. The load bars 68 are provided with eyebolts 72 which support a hoist 74 which can be rolled along the length of the radial transfer track 44 either normally or by means of a trolley motor 76. The hoist arrangement 60 is conventional and is provided with a hook 78 for attaching to and supporting loads.

The radial transfer track 44 has a swinging end 80 which is supported for a swinging movement along the arcuate support track 40 by means of a carrier 82 having a pair of wheels 84, 86 rotabably supported on members 88, 90 which are secured by bolts 92 to the upper flange 56 of the radial transfer track 44. Wheels 84, 86 ride on a lower flange 41 of the arcuate support track 40.

The swinging end 80 is provided with an interlock device 94 having a nose 96 secured to one end of a rod 98 slidably supported by a bracket 100 secured to the stem portion of the radial transfer track 44. Coupled to the nose 96 is a stop lever 102 which, in the position shown in FIG. 2, acts as a barrier to prevent the hoist arrangement 60 from running off the swinging end 80 of the radial transfer track 44.

Each of the terminals 32, 34 of the loop track 24 and the terminals 36, 38 of the spur tracks 26, 28 are provided with a coupling bracket 104 provided with a pivotable stop lever 106 which, similarly to stop lever 102, acts as a barrier to prevent the hoist arrangement 60 from running off the end of the spur track 26. The interlock device 94 and the coupling bracket 104 are of well-known construction such as those manufactured by Whiting Corporation of Harvey, Ill.

Although the carrier 82 is shown as using only a pair of wheels 84, 86, it is apparent that a carrier may be fabricated to include more than one pair of wheels to support the swinging end 80 of the radial transfer track 44, depending on load requirements.

Figure 3:
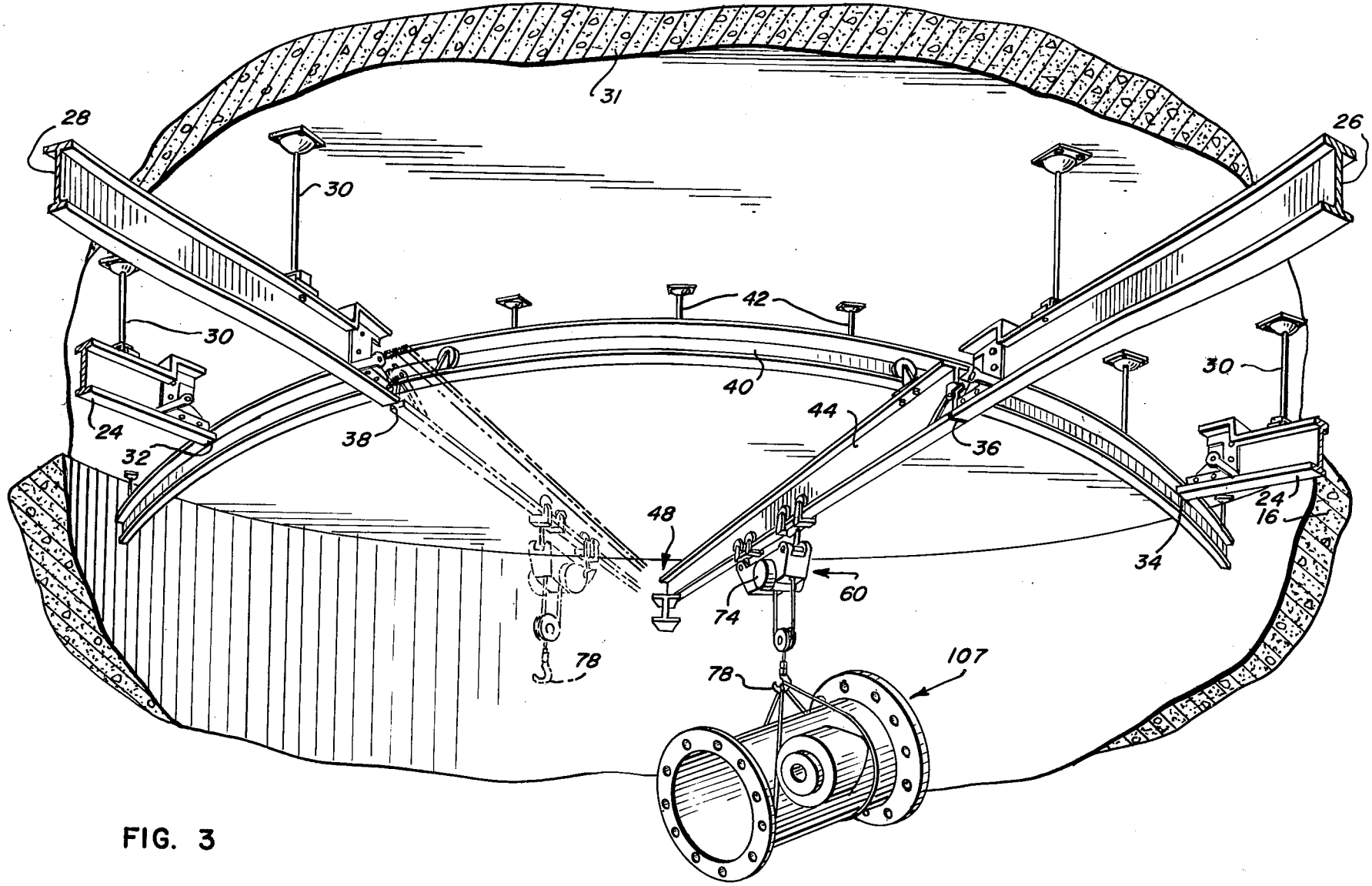
FIG. 3 is a partial perspective view of the load handling system, as supported from an overhead structure.

FIG. 3 shows a perspective view, looking upwardly, illustrating the equipment handling system and its manner of support from the ceiling 31. As can readily be observed, the ends of the loop track 24 and the ends of the spur tracks 26, 28 converge in a direction toward a point of support 48 which represents a pivotal mounting for the end 46 of the radial transfer track 44. The radial transfer track 44, as shown, supports the movable hoist arrangement 60 from which is suspended an upper portion 107 of MSI valve, such as **22*c*. Since the swinging end 80 of the radial transfer track 44 is rotatably supported on the arcuate support track 40, the radial transfer track 44 may be pivoted to any position along the arcuate support track 40, such as illustrated in dotted lines, wherein the radial transfer track 44 is coupled to the spur track 28**.

After the nuclear power plant is shut down for servicing purposes, the various valves, which have to be inspected for operating efficiency, are removed from the drywell area 14 to an inspection area located outside of containment wall 18. Assuming that it is desired to inspect one of the MSI valves, since these are located in the area spanned by the radial transfer track 44, the track is swung into a position directly over one of the MSI valves, such as **22*c*. After the bolts are removed from the coupling flange on valve 22*a*, the hoist arrangement 60 is operated to pull out the dismantled upper portion 107 out of the valve housing (not shown) and then elevated to a transporting position. Thereafter, the radial transfer track 44 is swung to a position to couple with terminal 32 on the loop track 24. Spacing between the terminal 32 and the swinging end is about 3/16 of an inch. Thereafter, rod 98 is operated so the nose 96 moves into a notch 108 in the coupling bracket 104. The movement of the nose into the notch is responsible for pivoting the lower end of the stop lever 102 into an upward position and, simultaneously, causes a movement of the lower end of stop level 106 into an upper position. When the coupling has been completed, the hoist arrangement 60 is in position to be rolled off the radial transfer track 44 onto the loop track 24 so the upper portion 107 of the valve 22*c* carried by hoist 74 can be transported to a removal area 110, wherein the upper portion 107 is placed on a wheeled carrier which can then be moved through a hatch opening 112 in the drywell wall 16** and taken to an inspection or maintenance area.

After the removed upper portion 107 has been inspected or, if necessary, replaced, the upper portion 107 is wheeled back to the removal area 110, hoisted and then returned by the hoist arrangement 60 over the loop track 24. Thereafter, the hoisted load is transferred to the radial transfer track 44 which is then pivoted over the valve housing undergoing inspection so that replacement of the upper portion can be completed.

Assuming that it is necessary to check one or more of the safety relief valves 20, for example valve **20*a*, the radial transfer track 44 together with its hoist arrangement 60 is swung around until the swinging end 80 lines up with terminal 36 of the spur track 26, as shown in FIG. 1. The swinging end 80 is then coupled to terminal 36 by means of the coupling bracket 104. Thereafter, the hoist arrangement 60 is rolled from the radial transfer track 44 onto the spur track 26 to occupy a position directly over valve 20*a*. After valve 20*a* has been uncoupled from its installed position, it is winched upwardly and then moved along the spur track 26 back onto the radial transfer track 44. Rod 98 is then operated to withdraw the nose 96 from the coupling bracket 104, causing thereby the stop levers 102, 106** to be pivoted downwardly.

After the valve **20*a* has been transferred from the spur track 26 onto the radial transfer track 44, the track is swung into a position so its swinging end 80 is opposite terminal 32 of the loop track 24. A coupling is then established, by means of the rod 98 and the coupling bracket 104 as previously described, so that the hoist arrangement 60, together with the suspended valve 20***a* can be moved over the loop track 24 to the removal area 110 and then subsequently removed through the hatch opening 112.

Since dimensional changes may take place as a result of expansion or contraction in the radial transfer track 44 and loop track 24, spur tracks 26, 28 or some other constructional disturbances may occur and thereby cause an interference between the swinging end 80 and terminals 32, 34, 36 or 38, the radial transfer track 44 is provided, in its upper flange 56, with elongated slotted openings (not shown) for admitting the bolts 92. Further, the pivot securement of the radial transfer track 44 at the support point 48 is adjustably supported by the bracket 54 or any other appropriate means. Thus, the radial transfer track 44 can be adjustably positioned with respect to terminals of the loop and spur tracks to provide the desired opening which will permit the hoist arrangement to be properly transferred to and from the radial transfer track 44. In the alternative, the pivot bearing 52 may be so mounted on beam support 50 as to permit movement of the radial transfer track 44 with respect to the terminals on the loop and spur tracks.

As was briefly indicated previously, the load handling system can be initially installed after the nuclear power plant building has been erected with the drywell ceiling 31 provided with a series of precisely positioned hangers 30. These positioned hangers will accurately support the tracks 24, 26 28 directly over the positions occupied by the relief safety valves 20 or other equipment which it is desired to service. However, the drywell ceiling 31 may also be provided with additional hangers 30 to accommodate the support of additional tracks in the future, as may be desired.

In the event that a track is not positioned directly over a desired position because of re-design or change in equipment installation, the track may be adjustably positional by being supported by a combination of two or more hangers 30. For example, if it were desired to adjust the position of the spur track 24 along the path concentric to the arcuate support track 40, a horizontal bar (not shown) could be attached between two adjoining hangers 30 and the track 24 would then be secured to the horizontal bar, thereby providing some measure of adjustability.

Aside from the advantage of the present invention, as has already been discussed, the feature of supporting the load handling system should be contrasted with the conventional system using horizontal girders to support the tracks and glide switches at each track interchange. Generally, these horizontal girders extend between the shield wall 12 and the drywell wall 16, with the ends of the girders being secured to both of these walls. Such an arrangement is not considered to be desirable in view of possible earth tremors which would affect adversely the seismic design of the shield wall. Such disadvantage is solved with the present invention by providing support for the system solely from the drywell ceiling, with no structural interconnection with the shield wall housing the nuclear core.

As can be seen, a simplified equipment handling system has been provided using a minimum of overhead supports for the radial transfer track as well as supporting the radial transfer track adjustably to obtain the proper relationship between the radial transfer track and the loop and spur tracks.

What is claimed is:

1. In a load-handling system of the type wherein monorail tracks are suspended from overhead support means to overlie a service area having a perimeter defined by the wall of a building, said system including a transfer track having one end disposed adjacent said wall, pivot support means pivotally mounting said one end of the transfer track adjacent said wall above said service area, the other end of said transfer track extending into and overlying said service area and being movable along an arcuate path overlying a substantial portion of said service area as the transfer track is pivoted about said pivot support means, means for supporting said other end of said transfer track including an arcuate support track suspended from said overhead support means in general alignment with said arcuate path, and carrier means movably interconnecting said other end of said transfer track with said arcuate support track, said system further including a plurality of tracks suspended from said overhead support means and individually overlying said service area, each of said tracks having an end terminating adjacent said arcuate support track and with all of said track ends converging toward a common point coaxial with said pivot support means, said arcuate support track and said plurality of tracks each being individually suspended directly from said overhead support means, and means for effecting a coupling between said other end of said transfer track and the end of a selected one of said tracks, whereby a load supported on one of said tracks can be moved onto said transfer track for movement to another one of said tracks.

2. In a load handling system using monorail tracks suspended from an overhead support means, a transfer track adapted to service a maintenance area defined by an arcuate perimeter, pivot means for pivotally securing one end of said transfer track coaxially with respect to said perimeter, the other end of said transfer track terminating adjoining said perimeter, an arcuate support track suspended from said overhead support means in concentric relationship to said perimeter, carrier means for movably suspending said other end of said transfer track from said arcuate support track, whereby said transfer track can sweep over said entire maintenance area, said monorail tracks having ends converging in a direction toward said pivot means and terminating adjoining said perimeter, said arcuate support track and said monorail tracks each being individually suspended directly from said overhead support means, and coupling means for effecting a coupling between said transfer track and a converging end of any selected one of said monorail tracks.

3. The system according to claim 1, wherein all of said tracks are provided with upper and lower flanges, said free end of said transfer track being suspended by said carrier means from the lower flange of said arcuate support track.

4. The system according to claim 3, wherein said carrier means has at least one pair of wheels rotatably supported on members secured to the upper flange of said transfer track, said wheels riding on the upper surface of the lower flange of said arcuate support track.

5. In a load handling system for transporting loads in a congested area filled with structural members and operating devices and having very limited spatial clearances therebetween wherein monorail tracks are suspended from overhead support means to overlie said area, said system comprising a flanged loop track supported from said overhead support means, one or more flanged spur tracks supported from said overhead support means, all of said tracks having ends converging in a direction toward a common point and terminating along a common arcuate path, an arcuate support track supported from said overhead support means in concentric relationship to said arcuate path, said arcuate support track and said plurality of tracks each being individually suspended directly from said overhead support means, said arcuate support track having upper and lower flanges and being disposed above the level of said converging ends of said loop and spur tracks, a flanged radial transfer track, a bracket for pivotally securing one end of said radial transfer track at said common point, carrier means for movably suspending the other end of said radial transfer track from the bottom flange on said arcuate support track, said carrier means being compact and substantially confined in an area defined by the width of the bottom flange on said arcuate support track, said free end of said radial transfer track being spaced a predetermined distance from the converging ends of said loop and spur tracks for movement along said arcuate path, coupling means provided on the free end of said radial transfer track to effect coupling with any one of said loop and spur tracks when the radial transfer track is radially aligned with a selected one of said loop or spur tracks, whereby a load-handling device can move loads along selected ones of said loop and spur tracks onto said radial transfer track for subsequent transfer of the load to another selected loop or spur track.

6. The system according to claim 5, wherein said arcuate path defines a perimeter of a maintenance area containing operating apparatus subject to periodic maintenance and testing, and the converging ends of said loop and spur tracks are each provided with a bracket for interconnection with said coupling means on said free end of said radial transfer track.

7. The system according to claim 5 wherein the congested area comprises a service area surrounding a reactor core in a nuclear power plant, and wherein said flanged loop track substantially surrounds said reactor core and said spur tracks are disposed in various portions of said plant, said radial transfer track being arranged for movement over a substantial portion of said service area in which there is a concentration of said operating devices, each of said converging ends of said loop and spur tracks being provided with a bracket for interconnection with said coupling means on said free end of said transfer track, whereby operating devices can be removed by said load handling device from said portion of said service area and transfered via said transfer track to one of said loop or spur tracks for subsequent removal from said plant to undergo inspection and servicing.

* * * * *